US009443474B2

(12) United States Patent
Eom et al.

(10) Patent No.: US 9,443,474 B2
(45) Date of Patent: Sep. 13, 2016

(54) ORGANIC LIGHT EMITTING DISPLAY APPARATUS AND METHOD OF DRIVING THE SAME

(71) Applicants: Ji-Hye Eom, Yongin (KR); Do-Ik Kim, Yongin (KR)

(72) Inventors: Ji-Hye Eom, Yongin (KR); Do-Ik Kim, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 173 days.

(21) Appl. No.: 13/897,595

(22) Filed: May 20, 2013

(65) Prior Publication Data

US 2014/0009509 A1 Jan. 9, 2014

(30) Foreign Application Priority Data

Jul. 6, 2012 (KR) ..... 10-2012-0073887

(51) Int. Cl.
*G09G 3/32* (2016.01)

(52) U.S. Cl.
CPC ..... *G09G 3/3291* (2013.01); *G09G 3/3225* (2013.01); *G09G 2300/0426* (2013.01); *G09G 2320/0223* (2013.01); *G09G 2330/00* (2013.01); *G09G 2330/028* (2013.01)

(58) Field of Classification Search
CPC ..... G09G 2320/0233
USPC ..... 257/88; 315/619.3; 345/211, 30, 67, 345/690, 76, 82, 87; 348/615; 445/24
See application file for complete search history.

(56) References Cited

U.S. PATENT DOCUMENTS

| | | | | |
|---|---|---|---|---|
| 6,309,271 | B1 * | 10/2001 | Kim | 445/24 |
| 2008/0238843 | A1 * | 10/2008 | Yatabe | 345/87 |
| 2011/0075038 | A1 * | 3/2011 | Yamazaki et al. | 348/615 |

FOREIGN PATENT DOCUMENTS

| | | | |
|---|---|---|---|
| KR | 102-005-0022993 | A | 3/2005 |
| KR | 10-0732811 | B1 | 6/2007 |
| KR | 10-2009-0078633 | A | 7/2009 |

* cited by examiner

*Primary Examiner* — Dwayne Bost
*Assistant Examiner* — Sepehr Azari
(74) *Attorney, Agent, or Firm* — Lee & Morse, P.C.

(57) ABSTRACT

An organic light emitting display apparatus includes a power generating unit and a display panel. The power generating unit generates a first power voltage and a second power voltage. The display panel includes a plurality of organic light emitting elements. The organic light emitting elements have first electrodes to which the first power voltage is applied in a first direction and second electrodes to which the second power voltage is applied in a second direction.

20 Claims, 3 Drawing Sheets

ORGANIC LIGHT EMITTING DISPLAY APPARATUS AND METHOD OF DRIVING THE SAME

CROSS-REFERENCE TO RELATED APPLICATION

This application claims priority under 35 USC §119 to Korean Patent Application No. 10-2012-0073887, filed on Jul. 6, 2012 in the Korean Intellectual Property Office (KIPO), the contents of which are incorporated herein in its entirety by reference.

BACKGROUND

1. Field

Example embodiments relate generally to an organic light emitting display apparatus and a method of driving the organic light emitting display apparatus.

2. Description of the Related Art

Flat display apparatuses of reduced weight and volume have been developed as a substitute for cathode ray tubes. Flat display apparatuses include a liquid crystal display ("LCD), a field emission display ("FED"), a plasma display panel ("PDP"), an organic light emitting display ("OLED"), etc. The organic light emitting display apparatus displays an image using an organic light emitting diode which generates light by combination of an electron and a positive hole. The organic light emitting display apparatus has a quick response and a low power consumption.

SUMMARY

Embodiments are directed to an organic light emitting display apparatus including a power generating unit generating a first power voltage and a second power voltage, and a display panel including a plurality of organic light emitting elements, the organic light emitting elements having first electrodes to which the first power voltage is applied in a first direction and second electrodes to which the second power voltage is applied in a second direction.

The power generating unit may be adjacent to a first side of the display panel. The first power voltage may be applied from a second side of the display panel, which is opposite to the first side of the display panel, toward the first side of the display panel. The second power voltage may be applied from the first side of the display panel toward the second side of the display panel.

The display panel may further include a power line transmitting the first power voltage to the first electrodes. The power line may include a common portion disposed adjacent to the first side of the display panel, an extending portion extending in the first direction, a detour portion connecting the extending portion to the common portion, and branch portions connected to the extending portion, each branch portion being connected to one of the first electrodes.

The common portion may extend in a direction substantially perpendicular to the first direction. The common portion may be connected to a plurality of the detour portions.

The detour portion may include a first portion extending from the common portion in the second direction and a second portion connecting the first portion to the extending portion.

The extending portion may include a plurality of extending portions, and the detour portion may be connected to the plurality of the extending portions.

The first power voltage may include a first color power voltage applied to a first color subpixel, a second color power voltage applied to a second color subpixel and a third color power voltage applied to a third color subpixel.

The display panel further may include a first power line transmitting the first color power voltage to the first electrode in the first color subpixel, a second power line transmitting the second color power voltage to the first electrode in the second color subpixel and a third power line transmitting the third color power voltage to the first electrode in the third color subpixel.

The first power line may include a first common portion disposed adjacent to the first side of the display panel, a first extending portion extending in the first direction, a first detour portion connecting the first extending portion to the first common portion, and a first branch portion connected to the first extending portion and the first electrode in the first color subpixel. The second power line may include a second common portion disposed adjacent to the first side of the display panel, a second extending portion extending in the first direction, a second detour portion connecting the second extending portion to the second common portion, and a second branch portion connected to the second extending portion and the first electrode in the second color subpixel. The third power line may include a third common portion disposed adjacent to the first side of the display panel, a third extending portion extending in the first direction, a third detour portion connecting the third extending portion to the third common portion, and a third branch portion connected to the third extending portion and the first electrode in the third color subpixel.

The display panel further may include a cathode contact portion applying the second power voltage to the second electrodes.

The cathode contact portion may be adjacent to the first side of the display panel.

The second electrodes of the organic light emitting elements may be integrally formed.

Embodiments are also directed to a method of driving an organic light emitting display apparatus. The method includes applying a first power voltage to first electrodes of a plurality of organic light emitting elements in a first direction, and applying a second power voltage to second electrodes of the organic light emitting elements in a second direction.

The first power voltage and the second power voltage may be provided to a display panel at a first side of the display panel. The first power voltage may be applied from a second side of the display panel, which is opposite to the first side of the display panel, toward the first side of the display panel. The second power voltage may be applied from the first side of the display panel toward the second side of the display panel.

A power line transmitting the first power voltage may be applied to the first electrodes through a power line. The power line may include a common portion adjacent to the first side of the display panel, an extending portion extending in the first direction, a detour portion connecting the extending portion to the common portion, and a branch portion connected to the extending portion and the first electrode.

The single detour portion may be connected to a plurality of the extending portions.

The first power voltage may include a first color power voltage applied to a first color subpixel, a second color power voltage applied to a second color subpixel and a third color power voltage applied to a third color subpixel.

The second power voltage may be applied to the second electrodes through a cathode contact portion of the display panel.

The cathode contact portion may be adjacent to the first side of the display panel.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
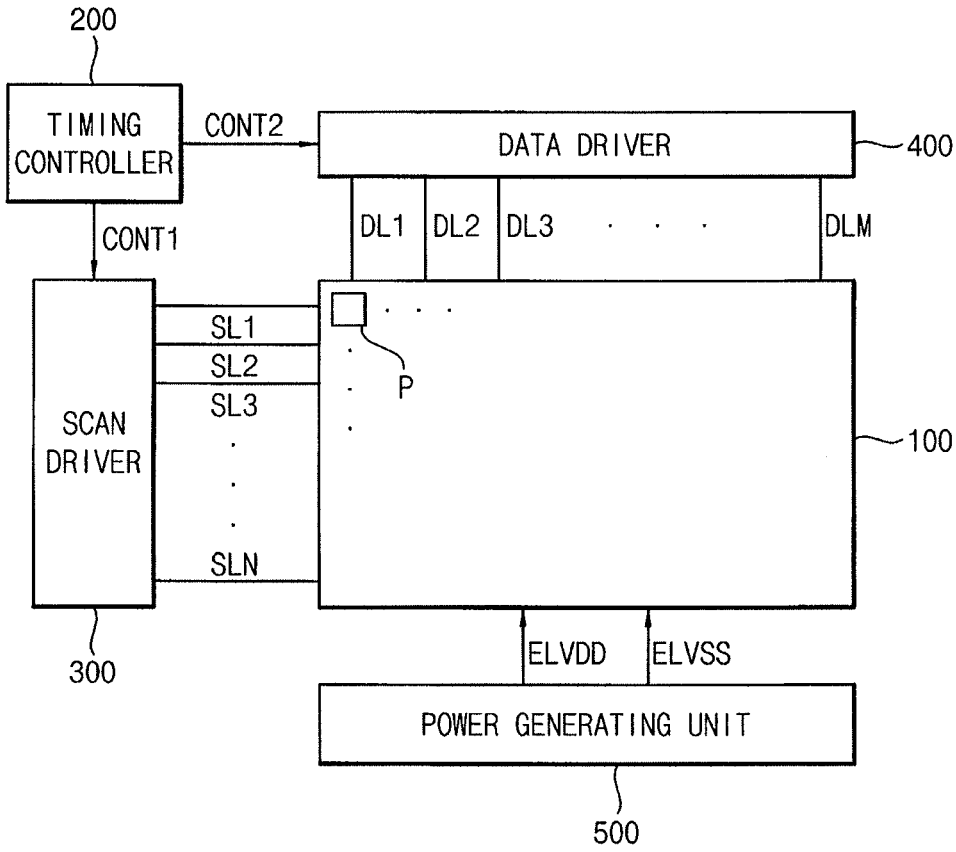
FIG. 1 is a block diagram illustrating an organic light emitting display apparatus according to example embodiments.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings thereof. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of skill in the relevant art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating an organic light emitting display apparatus according to example embodiments.

Referring to FIG. 1, the organic light emitting display apparatus includes a display panel 100, a timing controller 200, a scan driver 300, a data driver 400 and a power generating unit 500.

In an example embodiment, the timing controller 200, the scan driver 300, the data driver 400 and the power generating unit 500 may be formed in an integrated circuit ("IC") chip.

In an example embodiment, the scan driver 300 may be mounted on the display panel 100 or integrated on the display panel 100. In an example embodiment, the data driver 400 may be mounted on the display panel 100 or integrated on the display panel 100.

The display panel 100 displays an image. The display panel 100 includes a plurality of scan lines SL1 to SLN, a plurality of data lines DL1 to DLM and a plurality of subpixels P connected to the scan lines SL1 to SLN and the data lines DL1 to DLM. For example, the subpixels P may be disposed in a matrix form.

In an example embodiment, the number of the scan lines may be N. The number of the data lines may be M. Herein, N and M are positive integers. In an example embodiment, the number of subpixels P may be N×M. In an example embodiment, a pixel may include three subpixels P so that the number of the pixels may be ⅓×N×M.

The display panel 100 is connected to the scan driver 300 through the scan lines SL1 to SLN. The display panel 100 is connected to the data driver 400 through the data lines DL1 to DLM.

The display panel 100 receives a first power voltage ELVDD and a second power voltage ELVSS from the power generating unit 500. The first power voltage ELVDD may be applied to a first electrode of an organic light emitting element of the subpixel P. The second power voltage ELVSS may be applied to the second electrode of the organic light emitting element of the subpixel P. A pixel structure of the display panel 100 is explained in detail referring to FIG. 2. A power line transmitting the first power voltage ELVDD is explained in detail referring to FIG. 3.

The timing controller 200 generates a first control signal CONT1 for controlling a driving timing of the scan driver 300. The timing controller 200 outputs the first control signal CONT1 to the scan driver 300. The timing controller 200 generates a second control signal CONT2 for controlling a driving timing of the data driver 400. The timing controller 200 outputs the second control signal CONT2 to the data driver 400.

The scan driver 300 generates scan signals to drive the scan lines SL1 to SLN in response to the first control signal CONT1 received from the timing controller 200. The scan driver 300 sequentially outputs the scan signals to the scan lines SL1 to SLN.

The data driver 400 generates data signals to drive the data lines DL1 to DLM in response to the second control signal CONT2 received from the timing controller 200. The data driver 400 outputs the data signals to the data lines DL1 to DLM.

The power generating unit 500 generates the first power voltage ELVDD and the second power voltage ELVSS. The power generating unit 500 provides the first power voltage ELVDD and the second power voltage ELVSS to the display panel 100.

The first power voltage ELVDD is applied to the first electrode of the organic light emitting element of the subpixel P. The second power voltage ELVSS is applied to the second electrode of the organic light emitting element of the subpixel P. For example, the first power voltage ELVDD may be greater than the second power voltage ELVSS.

Figure 2:
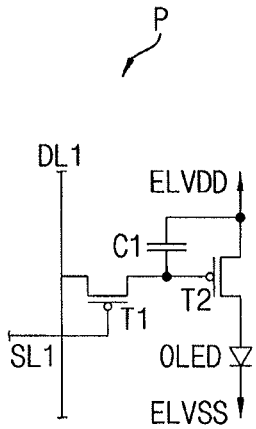
FIG. 2 is a circuit diagram illustrating a pixel structure of a display panel of FIG. 1.

FIG. 2 is a circuit diagram illustrating a pixel structure of the display panel 100 of FIG. 1.

Referring to FIGS. 1 and 2, the subpixel P includes a first switching element T1, a second switching element T2, a storing capacitor C1 and an organic light emitting element OLED.

The first switching element T1 may be a thin film transistor. The first switching element T1 includes a control electrode connected to a scan line SL1, an input electrode connected to a data line DL1 and an output electrode connected to a control electrode of the second switching element T2.

The control electrode of the first switching element T1 may be a gate electrode.

The input electrode of the first switching element T1 may be a source electrode. The output electrode of the first switching element T1 may be a drain electrode.

The second switching element T2 includes a control electrode connected to the output electrode of the first switching element T1, an input electrode to which the first power voltage ELVDD is applied and an output electrode connected to a first electrode of the organic light emitting element OLED.

The second switching element T2 may be a thin film transistor. The control electrode of the second switching element T2 may be a gate electrode. The input electrode of the second switching element T2 may be a source electrode. The output electrode of the second switching element T2 may be a drain electrode.

A first terminal of the storing capacitor C1 is connected to the input electrode of the second switching element T2. A second terminal of the storing capacitor C1 is connected to the output electrode of the first switching element T1.

The first electrode of the organic light emitting element OLED is connected to the output electrode of the second switching element T2. The second power voltage ELVSS is applied to the second electrode of the organic light emitting element OLED.

The first electrode of the organic light emitting element OLED may be an anode electrode. The second electrode of the organic light emitting element OLED may be a cathode electrode.

The subpixel P receives the scan signal, the data signal, the first power voltage ELVDD and the second power voltage ELVSS and emits light having a luminance corresponding to the data signal to display an image.

Figure 3:
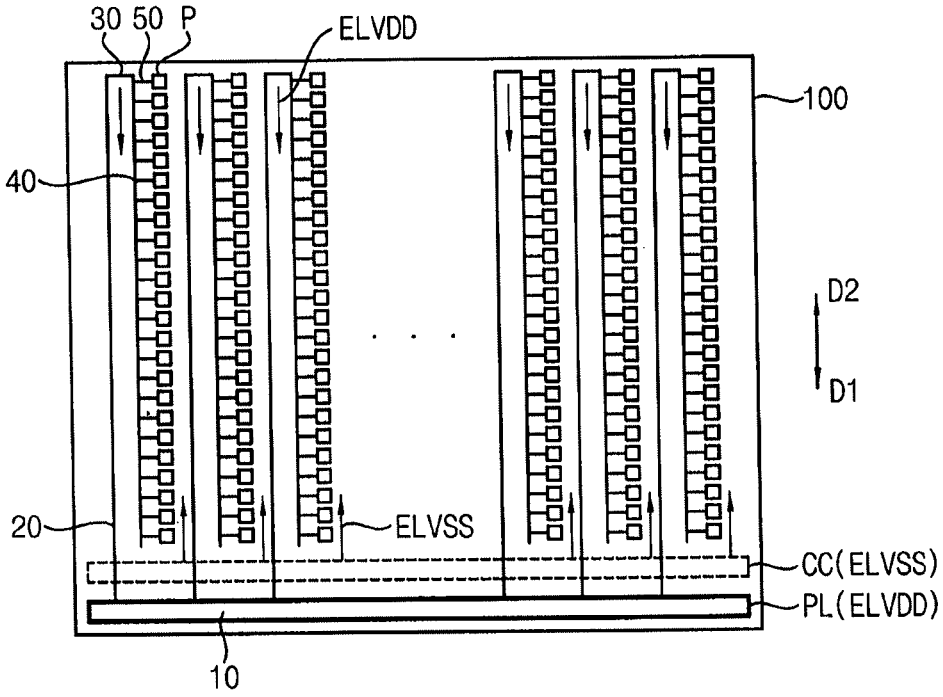
FIG. 3 is a plan view illustrating a power line and a cathode contact portion of the display panel of FIG. 1.

FIG. 3 is a plan view illustrating a power line PL and a cathode contact portion CC of the display panel of FIG. 1.

Referring to FIGS. 1 to 3, the power generating unit 500 is disposed adjacent to a first side of the display panel 100. The power generating unit 500 provides the first power voltage ELVDD and the second power voltage ELVSS to the display panel 100. For example, the first side of the display panel 100 may be a lower side of the display panel 100. Herein, terms such as lower side (first side) and upper side (second side) may be understood from a viewer's perspective with respect to a bottom edge and top edge of an upright viewed display panel 100. Moreover, the display panel 100 may be idealized as being essentially planar and the power line PL may be considered as being in the plane of the display panel 100.

The display panel 100 further includes a power line PL transmitting the first power voltage ELVDD received from the power generating unit 500 to the first electrodes of the organic light emitting elements OLED of the subpixels.

The power line PL includes a common portion 10, a detour portion 20 and 30, an extending portion 40 and a branch portion 50.

The common portion 10 is disposed adjacent to the first side of the display panel 100. The common portion 10 may extend in a direction substantially parallel with the first side of the display panel. The common portion 10 may extend in a direction substantially perpendicular to an extending direction of the extending portion 40. The common portion 10 is connected to a plurality of the detour portions 20 and 30. The display panel 100 may include the single common portion 10.

The extending portion 40 extends in a first direction D1. The first direction D1 may be a direction from a second side of the display panel 100, which is opposite to the first side of the display panel 100, toward the first side of the display panel 100. The first direction D1 may be a downward vertical direction of the display panel 100. For example, the first direction D1 may be a direction from an upper portion of the display panel 100 toward a lower portion of the display panel 100. For example, extending portion 40 may include a plurality of extending portions 40, and the number of the extending portions 40 may be substantially the same as the number of the data lines. In other implementations, the number of the extending portion 40 may be less than the number of the data lines.

The detour portion 20 and 30 connects the extending portion 40 to the common portion 10. The detour portion 20 and 30 has a first portion 20 extending from the common portion 10 in a second direction D2, which is opposite to the first direction D1, and a second portion 30 connecting the first portion 20 to the extending portion 40. The second portion 30 extends in a direction different from an extending direction of the first portion 20. The second portion 30 may extend in a direction substantially perpendicular to the first direction D1.

The second direction D2 may be a direction from the first side of the display panel 100 to the second side of the display panel 100. The second direction D2 may be an upward vertical direction of the display panel 100. For example, the first direction D1 may be a direction from the lower portion of the display panel 100 toward the upper portion of the display panel 100.

The branch portion 50 is connected to the extending portion 40 and the first electrode of the organic light emitting element OLED. The branch portion 50 may include a plurality of branch portions 50, and a plurality of the branch portions 50 may be connected to a single one of the extending portions 40. The number of the branch portions 50 connected to the single extending portion 40 may be substantially the same as the number of the scan lines. The branch portion 50 may extend in a direction substantially perpendicular to the first direction D1.

Therefore, the first power voltage ELVDD sequentially passes through the common portion 10, the detour portion 20 and 30, the extending portion 40 and the branch portion 50 so that the first power voltage ELVDD is applied to the first electrodes of the organic light emitting elements OLED in a direction from the second side of the display panel 200 toward the first side of the display panel 100.

The display panel 100 further includes a cathode contact portion CC applying the second power voltage ELVSS to the second electrodes of the organic light emitting element OLED of the subpixels P. The cathode contact portion CC is disposed adjacent to the first side of the display panel 100.

The second electrode of the organic light emitting element OLED is disposed on a layer different from a layer on which the first electrode of the organic light emitting element OLED is disposed. The cathode contact portion CC transmits the second power voltage ELVSS received from the power generating unit 500 to the layer on which the second electrode of the organic light emitting element OLED is disposed.

For example, the second electrodes of the organic light emitting elements OLED may be integrally formed.

Therefore, the second power voltage ELVSS is applied to the second electrodes of the organic light emitting elements OLED in a direction from the first side of the display panel 100 toward the second side of the display panel 100 on the layer on which the second electrodes of the organic light emitting element OLED is disposed.

Figure 4:
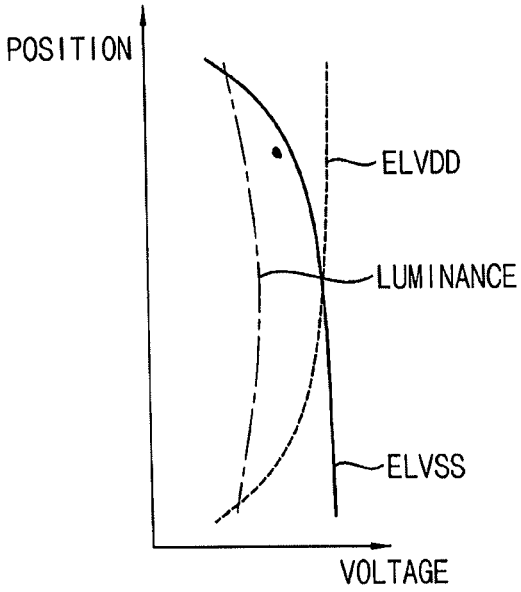
FIG. 4 is a graph illustrating a first power voltage, a second power voltage, and a luminance according to a position in the display panel of FIG. 1.

FIG. 4 is a graph illustrating the first power voltage ELVDD, the second power voltage ELVSS and a luminance according to a position in the display panel 100 of FIG. 1.

Referring to FIGS. 1 to 4, an X axis represents a level of the first power voltage ELVDD and a level of the second power voltage ELVSS and a Y axis represents a position in the display panel 100. As a Y coordinate value increases, the position gets farther away from the power generating unit 500. As the Y coordinate value decreases, the position gets closer to the power generating unit 500. The first side of the display panel 100 corresponds to the lowest portion of the Y axis. The second side of the display panel 100 corresponds to the highest portion of the Y axis.

The first power voltage ELVDD is applied in a direction from the second side of the display 100 to the first side of the display panel 100. The first power voltage ELVDD has a high level at a high Y coordinate value. As the Y coordinate value decreases, the first power voltage ELVDD decreases due to a voltage drop by resistance.

In contrast, the second power voltage ELVSS is applied in a direction from the first side of the display 100 to the second side of the display panel 100. The second power voltage ELVSS has a high level at a low Y coordinate value. As the Y coordinate value increases, the second power voltage ELVSS decreases due to a voltage drop by resistance.

The transmitting direction of the first power voltage ELVDD and the transmitting direction of the second power voltage ELVSS are opposite to each other. Thus, although both of the first power voltage ELVDD and the second power voltage ELVSS respectively have decreasing profiles due to the voltage drops, the display panel 100 may have substantially uniform luminance.

In addition, it may not be necessary to widen the power line PL to prevent a voltage drop of the first power voltage ELVDD. Accordingly, an aperture ratio of the display panel 100 may be improved.

According to the present example embodiments, the first power voltage ELVDD is applied to the first electrodes of the organic light emitting element OLED in the first direction D1 and the second power voltage ELVSS is applied to the second electrodes of the organic light emitting element OLED in the second direction D2 so that the voltage drop of the first power voltage ELVDD and the voltage drop of the second power voltage ELVSS cancel each other. Thus, a luminance uniformity of the display panel 100 may be improved.

In addition, the power line PL may have a relatively small width so that an aperture ratio of the display panel 100 may be improved. Thus, a display quality of the display apparatus may be improved.

Figure 5:
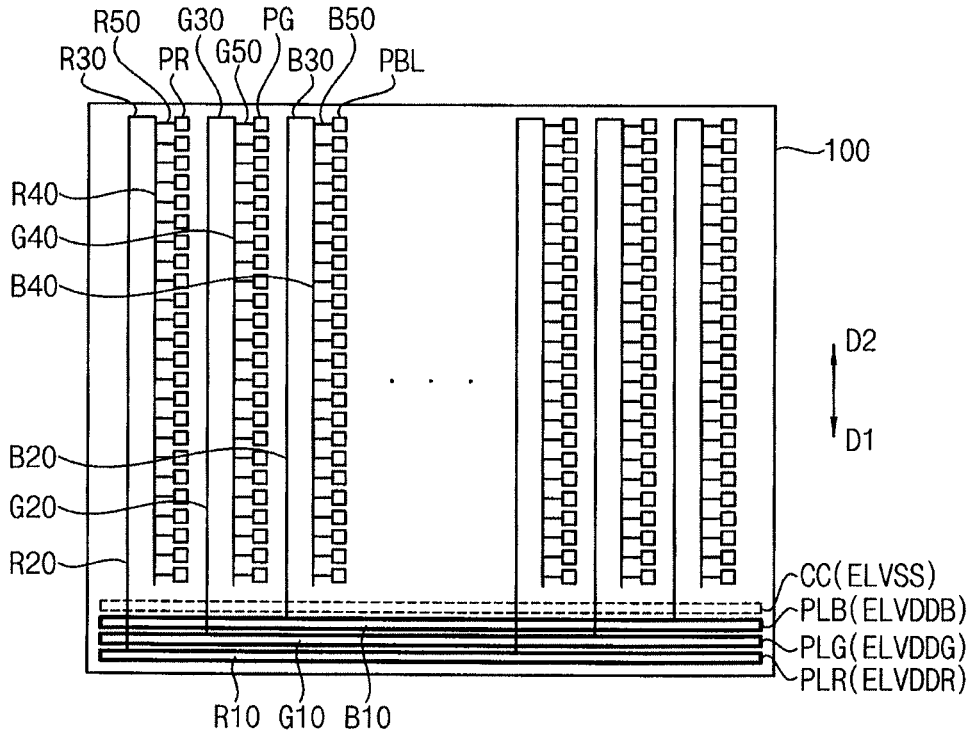
FIG. 5 is a plan view illustrating a power line and a cathode contact portion of a display panel of an organic light emitting display apparatus according to example embodiments.

FIG. 5 is a plan view illustrating a power line and a cathode contact portion of a display panel of an organic light emitting display apparatus according to example embodiments.

The organic light emitting display apparatus and the method of driving the organic light emitting display apparatus of FIG. 5 are substantially the same as the organic light emitting display apparatus and the method of driving the organic light emitting display apparatus explained referring to FIGS. 1 to 4 except that various power voltages are used according to colors of subpixels. Thus, the same reference numerals will be used to refer to the same or like parts as those described in the example embodiments of FIGS. 1 to 4.

Referring to FIGS. 1, 2 and 5, the organic light emitting display apparatus includes a display panel 100, a timing controller 200, a scan driver 300, a data driver 400 and a power generating unit 500.

The display panel 100 displays an image. The display panel 100 includes a plurality of scan lines SL1 to SLN, a plurality of data lines DL1 to DLM and a plurality of subpixels P connected to the scan lines SL1 to SLN and the data lines DL1 to DLM. For example, the subpixels P may be disposed in a matrix form.

The scan driver 300 generates scan signals to drive the scan lines SL1 to SLN in response to the first control signal CONT1 received from the timing controller 200. The scan driver 300 sequentially outputs the scan signals to the scan lines SL1 to SLN.

The data driver 400 generates data signals to drive the data lines DL1 to DLM in response to the second control signal CONT2 received from the timing controller 200. The data driver 400 outputs the data signals to the data lines DL1 to DLM.

The power generating unit 500 generates the first power voltage ELVDD and the second power voltage ELVSS. The power generating unit 500 provides the first power voltage ELVDD and the second power voltage ELVSS to the display panel 100.

The first power voltage ELVDD includes a first color power voltage ELVDDR applied to a first color subpixel, a second color power voltage ELVDDG applied to a second color subpixel and a third color power voltage ELVDDB applied to a third color subpixel.

For example, the first color may be red. The second color may be green. The third color may be blue.

The first color power voltage ELVDDR is applied to a first electrode of the organic light emitting element OLED of the first color subpixel PR. The second color power voltage ELVDDG is applied to a first electrode of the organic light emitting element OLED of the second color subpixel PG. The third color power voltage ELVDDB is applied to a first electrode of the organic light emitting element OLED of the third color subpixel PBL.

The second power voltage ELVSS is applied to second electrodes of the organic light emitting elements OLED of the first to third color subpixels PR, PG, and PBL.

For example, the first color power voltage ELVDDR, the second color power voltage ELVDDG and the third color power voltage ELVDDB may have different values from one another. The first to third color power voltages ELVDDR, ELVDDG, and ELVDDB may be respectively greater than the second power voltage ELVSS.

Each of the color subpixels PR, PG, and PBL includes a first switching element T1, a second switching element T2, a storing capacitor C1 and an organic light emitting element OLED.

The power generating unit 500 is disposed adjacent to a first side of the display panel 100. The power generating unit 500 provides the first to third color power voltages ELVDDR, ELVDDG, and ELVDDB and the second power voltage ELVSS to the display panel 100. For example, the first side of the display panel 100 may be a lower side of the display panel 100.

The display panel 100 further includes a first power line PLR transmitting the first color power voltage ELVDDR received from the power generating unit 500 to the first electrodes of the organic light emitting elements OLED of the first color subpixels PR, a second power line PLG transmitting the second color power voltage ELVDDG received from the power generating unit 500 to the first electrodes of the organic light emitting elements OLED of the second color subpixels PG and a third power line PLB transmitting the third color power voltage ELVDDB received from the power generating unit 500 to the first electrodes of the organic light emitting elements OLED of the third color subpixels PBL.

The first power line PLR includes a first common portion R10, a first detour portion R20 and R30, a first extending portion R40 and a first branch portion R50.

The first common portion R10 is disposed adjacent to the first side of the display panel 100.

The first extending portion R40 extends in a first direction D1. The first direction D1 may be a direction from a second side of the display panel 100, which is opposite to the first side of the display panel 100, to the first side of the display panel 100.

The first detour portion R20 and R30 connects the first extending portion R40 to the first common portion R10. The first detour portion R20 and R30 has a first portion R20 extending from the first common portion R10 in a second direction D2, which is opposite to the first direction D1, and a second portion R30 connecting the first portion R20 to the first extending portion R40. The second direction D2 may be a direction from the first side of the display panel 100 to the second side of the display panel 100.

The first branch portion R50 is connected to the first extending portion R40 and the first electrode of the organic light emitting element OLED. A plurality of the first branch portions R50 may be connected to the single first extending portion R40.

The second power line PLG includes a second common portion G10, a second detour portion G20 and G30, a second extending portion G40 and a second branch portion G50.

The second common portion G10 is disposed adjacent to the first side of the display panel 100. The second common portion G10 is disposed adjacent to the first common portion R10.

The second extending portion G40 extends in the first direction D1. The first direction D1 may be a direction from a second side of the display panel 100 to the first side of the display panel 100.

The second detour portion G20 and G30 connects the second extending portion G40 to the second common portion G10. The second detour portion G20 and G30 has a first portion G20 extending from the second common portion G10 in the second direction D2 and a second portion G30 connecting the first portion G20 to the second extending portion G40. The second direction D2 may be a direction from the first side of the display panel 100 to the second side of the display panel 100.

The second branch portion G50 is connected to the second extending portion G40 and the first electrode of the organic light emitting element OLED. A plurality of the second branch portions G50 may be connected to the single second extending portion G40.

The third power line PLB includes a third common portion B10, a third detour portion B20 and B30, a third extending portion B40 and a third branch portion B50.

The third common portion B10 is disposed adjacent to the first side of the display panel 100. The third common portion B10 is disposed adjacent to the second common portion G10.

The third extending portion B40 extends in the first direction D1. The first direction D1 may be a direction from a second side of the display panel 100 to the first side of the display panel 100.

The third detour portion B20 and B30 connects the third extending portion B40 to the third common portion B10. The third detour portion B20 and B30 has a first portion B20 extending from the third common portion B 10 in the second direction D2 and a second portion B30 connecting the first portion B20 to the third extending portion B40. The second direction D2 may be a direction from the first side of the display panel 100 to the second side of the display panel 100.

The third branch portion B50 is connected to the third extending portion B40 and the first electrode of the organic light emitting element OLED. A plurality of the third branch portions B50 may be connected to the single third extending portion B40.

Therefore, the first to third color power voltages ELVDDR, ELVDDG, and ELVDDB sequentially pass through the first to third common portions R10, G10, and B10, the first to third detour portions R20, R30, G20, G30, B20, and B30, the first to third extending portions R40, G40, and B40 and the first to third branch portions R50, G50, and B50 so that the first to third color power voltages ELVDDR, ELVDDG, and ELVDDB are applied to the first electrodes of the organic light emitting elements OLED of the first to third color subpixels PR, PG, and PBL in a direction from the second side of the display panel 200 toward the first side of the display panel 100.

The display panel 100 further includes a cathode contact portion CC applying the second power voltage ELVSS to the second electrodes of the organic light emitting element OLED of the first to third color subpixels PR, PG, and PBL. The cathode contact portion CC is disposed adjacent to the first side of the display panel 100.

Therefore, the second power voltage ELVSS is applied to the second electrodes of the organic light emitting elements OLED in a direction from the first side of the display panel 100 toward the second side of the display panel 100 on the layer on which the second electrodes of the organic light emitting element OLED is disposed.

According to the present example embodiments, the first to third color power voltages ELVDDR, ELVDDG, and ELVDDB are applied to the first electrodes of the organic light emitting element OLED in the first direction D1 and the second power voltage ELVSS is applied to the second electrodes of the organic light emitting element OLED in the second direction D2 so that the voltage drop of the first to third color power voltages ELVDDR, ELVDDG, and ELVDDB and the voltage drop of the second power voltage cancel each other. Thus, a luminance uniformity of the display panel 100 may be improved.

In addition, the first to third power lines PLR, PLG, and PLB may have relatively small widths so that an aperture ratio of the display panel 100 may be improved. Thus, a display quality of the display apparatus may be improved.

In addition, various power voltages ELVDDR, ELVDDG, and ELVDDB are used according to colors of the subpixels so that color characteristics of the display panel 100 may be improved and power efficiency may be improved.

Figure 6:
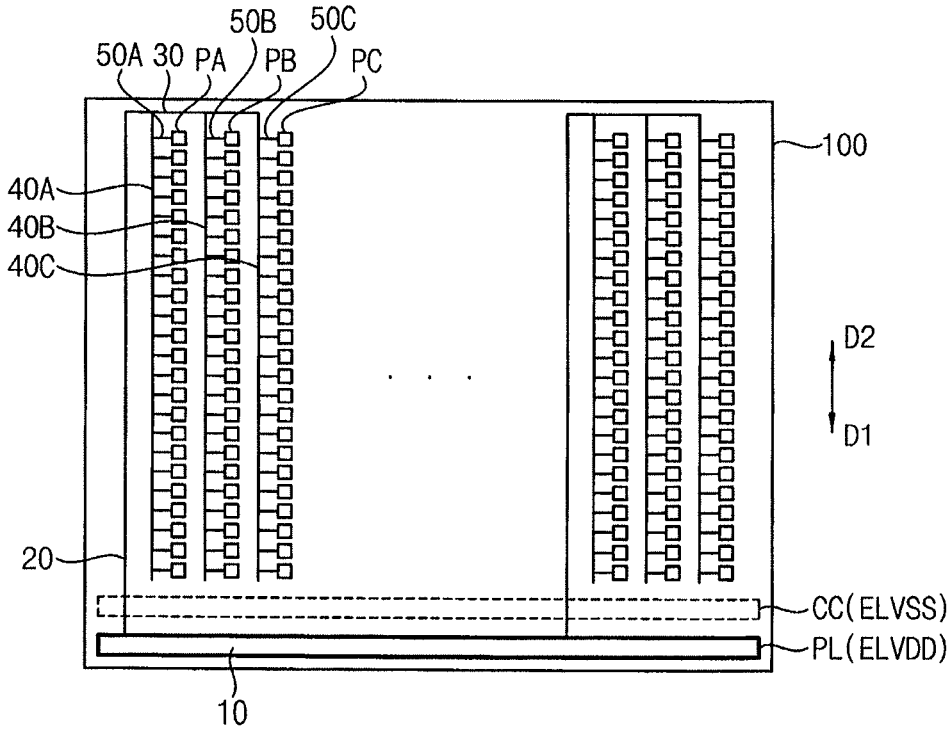
FIG. 6 is a plan view illustrating a power line and a cathode contact portion of a display panel of an organic light emitting display apparatus according to example embodiments.

FIG. 6 is a plan view illustrating a power line PL and a cathode contact portion CC of a display panel 100 of an organic light emitting display apparatus according to example embodiments.

The organic light emitting display apparatus and the method of driving the organic light emitting display apparatus of FIG. 6 are substantially the same as the organic light emitting display apparatus and the method of driving the organic light emitting display apparatus explained referring to FIGS. 1 to 4 except for a shape of the power line PL. Thus, the same reference numerals will be used to refer to the same or like parts as those described in the example embodiments of FIGS. 1 to 4.

Referring to FIGS. 1, 2 and 6, the organic light emitting display apparatus includes a display panel 100, a timing controller 200, a scan driver 300, a data driver 400 and a power generating unit 500.

The display panel 100 displays an image. The display panel 100 includes a plurality of scan lines SL1 to SLN, a plurality of data lines DL1 to DLM and a plurality of subpixels P connected to the scan lines SL1 to SLN and the data lines DL1 to DLM. For example, the subpixels P may be disposed in a matrix form.

The scan driver 300 generates scan signals to drive the scan lines SL1 to SLN in response to the first control signal CONT1 received from the timing controller 200. The scan driver 300 sequentially outputs the scan signals to the scan lines SL1 to SLN.

The data driver 400 generates data signals to drive the data lines DL1 to DLM in response to the second control signal CONT2 received from the timing controller 200. The data driver 400 outputs the data signals to the data lines DL1 to DLM.

The power generating unit 500 generates the first power voltage ELVDD and the second power voltage ELVSS. The power generating unit 500 provides the first power voltage ELVDD and the second power voltage ELVSS to the display panel 100.

The first power voltage ELVDD is applied to first electrodes of the organic light emitting elements OLED of the subpixels PA, PB, and PC. The second power voltage ELVSS is applied to second electrodes of the organic light emitting elements OLED of the subpixels PA, PB, and PC.

Each of the subpixels PA, PB, and PC includes a first switching element T1, a second switching element T2, a storing capacitor C1 and an organic light emitting element OLED.

The power generating unit 500 is disposed adjacent to a first side of the display panel 100. The power generating unit 500 provides the first power voltage ELVDD and the second power voltage ELVSS to the display panel 100. For example, the first side of the display panel 100 may be a lower side of the display panel 100.

The display panel 100 further includes a power line PL transmitting the first power voltage ELVDD received from the power generating unit 500 to the first electrodes of the organic light emitting elements OLED of the subpixels PA, PB and PC.

The power line PL includes a common portion 10, a detour portion 20 and 30, a plurality of extending portions 40A, 40B, and 40C and a plurality of branch portions 50A, 50B, and 50C.

The common portion 10 is disposed adjacent to the first side of the display panel 100.

The extending portions 40A, 40B, and 40C extend in a first direction D1. The first direction D1 may be a direction from a second side of the display panel 100, which is opposite to the first side of the display panel 100, toward the first side of the display panel 100.

The detour portion 20 and 30 is connected to the extending portions 40A, 40B, and 40C. The detour portion 20 and 30 connects the extending portions 40A, 40B, and 40C to the common portion 10. The detour portion 20 and 30 has a first portion 20 extending from the common portion 10 in a second direction D2, which is opposite to the first direction D1, and a second portion 30 connecting the first portion 20 to the extending portions 40A, 40B, and 40C. The second direction D2 may be a direction from the first side of the display panel 100 toward the second side of the display panel 100.

For example, the detour portion 20 and 30 is connected to three extending portions 40A, 40B and 40C. In other implementations, the number of extending portions may vary. For example, the detour portion 20 and 30 may be connected to two extending portions. As another example, the detour portion 20 and 30 may be connected to nine extending portions.

The branch portions 50A, 50B, and 50C are connected to the extending portions 40A, 40B, and 40C and the first electrodes of the organic light emitting elements OLED. A plurality of the branch portions 50A may be connected to the single extending portion 40A.

Therefore, the first power voltage ELVDD sequentially passes through the common portion 10, the detour portion 20 and 30, the extending portions 40A, 40B and 40C and the branch portions 50A, 50B, and 50C so that the first power voltage ELVDD is applied to the first electrodes of the organic light emitting elements OLED in a direction from the second side of the display panel 200 toward the first side of the display panel 100.

The display panel 100 further includes a cathode contact portion CC applying the second power voltage ELVSS to the second electrodes of the organic light emitting element OLED of the subpixels P. The cathode contact portion CC is disposed adjacent to the first side of the display panel 100.

Therefore, the second power voltage ELVSS is applied to the second electrodes of the organic light emitting elements OLED in a direction from the first side of the display panel 100 toward the second side of the display panel 100 on the layer on which the second electrodes of the organic light emitting element OLED is disposed.

According to the present example embodiments, the first power voltage ELVDD is applied to the first electrodes of the organic light emitting element OLED in the first direction D1 and the second power voltage ELVSS is applied to the second electrodes of the organic light emitting element OLED in the second direction D2 so that the voltage drop of the first power voltage ELVDD and the voltage drop of the second power voltage cancel each other. Thus, a luminance uniformity of the display panel 100 may be improved.

In addition, the power line PL may have a relatively small width so that an aperture ratio of the display panel 100 may be improved.

In addition, the plurality of extending portions 40A, 40B, and 40C are connected to the single detour part 20 and 30 so that the aperture ratio of the display panel 100 may be further improved. Thus, a display quality of the display apparatus may be improved.

By way of summation and review, a display apparatus such as an organic light emitting display apparatus includes a plurality of organic light emitting elements. A first power voltage may be applied to an anode electrode of the organic light emitting element and a second power voltage may be applied to a cathode electrode of the organic light emitting element.

A voltage drop may be generated in a power line transmitting the first power voltage to pixels and the cathode electrode to which the second power voltage is applied. Thus, a difference between a luminance in a region closer to a power generating unit and a luminance in a region far from the power generating unit may be generated. Thus, a luminance uniformity of a display panel may decrease.

Embodiments may provide a display apparatus such as an organic light emitting display apparatus in which transmitting paths of a first power voltage and a second power voltage are changed to improve a luminance uniformity of a display panel. Example embodiments may also provide a method of driving the organic light emitting display apparatus.

For example, a transmitting direction of the first power voltage and a transmitting direction of the second power voltage may be opposite to each other so that a luminance uniformity of a display panel may be improved. In addition, a power line is not required to be widened to prevent a voltage drop of the first power voltage so that an aperture ratio may be improved. Thus, a display quality of the organic light emitting display apparatus may be improved.

Embodiments may be applied to an electric device having a display apparatus such as an organic light emitting display apparatus. For example, embodiments may be applied to a television, a computer monitor, a laptop, a digital camera, a cellular phone, a smart phone, a personal digital assistant (PDA), a portable multimedia player (PMP), a MP3 player, a navigation system, a video phone, etc.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display apparatus, comprising:

a power generating unit generating a first power voltage and a second power voltage positioned on a side of said display apparatus orthogonally to an axis of an adjacent side of said display apparatus; and a display panel including a plurality of organic light emitting elements arranged along said axis extending away from the power generating unit, the organic light emitting elements having first electrodes to which the first power voltage is sequentially connected from a first direction beginning with the organic light emitting element farthest away from said power generating unit and concluding with the light emitting element closest to said power generating unit and with respect to said axis, and second electrodes to which the second power voltage is connected beginning with the organic light emitting element closest to the power generating unit and continuing sequentially in a second direction with respect to said axis, the second direction of sequential application of the second power voltage to the second electrodes being opposite the first direction of sequential application of the first power voltage to the first electrodes, wherein:

the display panel includes a first organic light emitting element and a second organic light emitting element arranged along the axis, the first power voltage is sequentially applied to the first organic light emitting element and the second organic light emitting element in the first direction, and the second power voltage is sequentially applied to the second organic light emitting element and the first organic light emitting element in the second direction.

2. The organic light emitting display apparatus of claim 1, wherein:

the power generating unit is adjacent to a first side of the display panel, the first power voltage is applied from a second side of the display panel, which is opposite to the first side of the display panel, toward the first side of the display panel, and the second power voltage is applied from the first side of the display panel toward the second side of the display panel.

3. The organic light emitting display apparatus of claim 2, wherein:

the display panel further includes a power line transmitting the first power voltage to the first electrodes, and the power line includes:

a common portion disposed adjacent to the first side of the display panel;

an extending portion extending in the first direction;

a detour portion connecting the extending portion to the common portion; and branch portions connected to the extending portion, each branch portion being connected to one of the first electrodes.

4. The organic light emitting display apparatus of claim 3, wherein the common portion extends in a direction substantially perpendicular to the first direction, and the common portion is connected to a plurality of the detour portions.

5. The organic light emitting display apparatus of claim 3, wherein:

the detour portion includes a first portion extending from the common portion in the second direction and a second portion connecting the first portion to the extending portion.

6. The organic light emitting display apparatus of claim 3, wherein:

the extending portion includes a plurality of extending portions, and the detour portion is connected to the plurality of the extending portions.

7. The organic light emitting display apparatus of claim 2, wherein the first power voltage includes a first color power voltage applied to a first color subpixel, a second color power voltage applied to a second color subpixel, and a third color power voltage applied to a third color subpixel.

8. The organic light emitting display apparatus of claim 7, wherein the display panel further includes a first power line transmitting the first color power voltage to the first electrode in the first color subpixel, a second power line transmitting the second color power voltage to the first electrode in the second color subpixel, and a third power line transmitting the third color power voltage to the first electrode in the third color subpixel.

9. The organic light emitting display apparatus of claim 7, wherein:

the first power line includes:

a first common portion disposed adjacent to the first side of the display panel;

a first extending portion extending in the first direction;

a first detour portion connecting the first extending portion to the first common portion; and a first branch portion connected to the first extending portion and the first electrode in the first color subpixel, the second power line includes:

a second common portion disposed adjacent to the first side of the display panel;

a second extending portion extending in the first direction;

a second detour portion connecting the second extending portion to the second common portion; and a second branch portion connected to the second extending portion and the first electrode in the second color subpixel, and the third power line includes:

a third common portion disposed adjacent to the first side of the display panel;

a third extending portion extending in the first direction;

a third detour portion connecting the third extending portion to the third common portion; and a third branch portion connected to the third extending portion and the first electrode in the third color subpixel.

10. The organic light emitting display apparatus of claim 2, wherein the display panel further includes a cathode contact portion applying the second power voltage to the second electrodes.

11. The organic light emitting display apparatus of claim 10, wherein the cathode contact portion is adjacent to the first side of the display panel.

12. The organic light emitting display apparatus of claim 10, wherein the second electrodes of the organic light emitting elements are integrally formed.

13. A method of driving the organic light emitting display apparatus of claim 1, the method comprising:

sequentially applying the first power voltage to the first electrodes of the plurality of organic light emitting elements arranged along said axis extending away from the power generating unit in the first direction along the axis; and sequentially applying the second power voltage to the second electrodes of the organic light emitting elements in the second direction along the axis, the second direction of sequential application of the second power voltage to the second electrodes being opposite the first direction of sequential application of the first power voltage to the first electrodes, wherein:

the organic light emitting display apparatus includes a first organic light emitting element and a second organic light emitting element arranged along the axis, the first power voltage is sequentially applied to the first organic light emitting element and the second organic light emitting element in the first direction, and the second power voltage is sequentially applied to the second organic light emitting element and the first organic light emitting element in the second direction.

14. The method of claim 13, wherein the first power voltage and the second power voltage are provided to a display panel at a first side of the display panel, the first power voltage is applied from a second side of the display panel, which is opposite to the first side of the display panel, toward the first side of the display panel, and the second power voltage is applied from the first side of the display panel toward the second side of the display panel.

15. The method of claim 14, wherein the first power voltage is applied to the first electrodes through a power line, the power line including:

a common portion adjacent to the first side of the display panel;

an extending portion extending in the first direction;

a detour portion connecting the extending portion to the common portion; and a branch portion connected to the extending portion and the first electrode.

16. The method of claim 15, wherein the single detour portion is connected to a plurality of the extending portions.

17. The method of claim 14, wherein the first power voltage includes a first color power voltage applied to a first color subpixel, a second color power voltage applied to a second color subpixel and a third color power voltage applied to a third color subpixel.

18. The method of claim 14, wherein the second power voltage is applied to the second electrodes through a cathode contact portion of the display panel.

19. The method of claim 18, wherein the cathode contact portion is adjacent to the first side of the display panel.

20. An organic light emitting display apparatus comprising:

a power generating unit generating a first power voltage and a second power voltage; and a display panel including a plurality of organic light emitting elements arranged along an axis, the organic light emitting elements having first electrodes to which the first power voltage is sequentially applied in a first direction along the axis and second electrodes to which the second power voltage is sequentially applied in a second direction along the axis, the second direction of sequential application of the second power voltage to the second electrodes being opposite the first direction of sequential application of the first power voltage to the first electrodes, wherein:

the display panel includes a first organic light emitting element and a second organic light emitting element arranged along the axis, the first power voltage is sequentially applied to the first organic light emitting element and the second organic light emitting element in the first direction, the second power voltage is sequentially applied to the second organic light emitting element and the first organic light emitting element in the second direction, the power generating unit is adjacent to a first side of the display panel, the first power voltage is applied from a second side of the display panel, which is opposite to the first side of the display panel, toward the first side of the display panel, the second power voltage is applied from the first side of the display panel toward the second side of the display panel, and the first power voltage decreases as a position in the display panel gets closer to the power generating unit in a direction from the second side of the display panel to the first side of the display panel, the second power voltage decreases as a position in the display panel gets farther away from the power generating unit in a direction from the first side of the display panel to the second side of the display panel, and the display panel has substantially uniform luminance.

* * * * *